United States Patent [19]

Lemelson

[11] 4,064,647

[45] Dec. 27, 1977

[54] CATAPULT LAUNCHED MODEL GLIDER

[76] Inventor: Jerome H. Lemelson, 85 Rector St., Metuchen, N.J. 08840

[21] Appl. No.: 693,417

[22] Filed: June 7, 1976

[51] Int. Cl.[2] ..... A63H 27/14

[52] U.S. Cl. ..... 46/81; 46/79

[58] Field of Search ..... 46/79, 81; 124/37

[56] References Cited

U.S. PATENT DOCUMENTS

| | | | |
|---|---|---|---|
| 3,177,612 | 4/1965 | Giossi | 46/81 |
| 3,496,671 | 2/1970 | Korona | 46/81 |
| 3,898,765 | 8/1975 | Lee | 46/81 |
| 3,905,350 | 9/1975 | Becker | 46/81 |

*Primary Examiner*—Louis G. Mancene
*Assistant Examiner*—Robert F. Cutting

[57] ABSTRACT

A flying toy in the form of a large, lightweight glider and a launcher therefore. In one form, the glider is formed of a lightweight cellular plastic and contains a rigid plastic attachment or insert connected to its body and defining a hook or retainer for the end of a loop of rubber band which is connected to the launcher and is released upon the pulling of a trigger. In a particular form the launcher is composed of an elongated rod shaped guideway containing left and right hand grips located respectively at the central portion of the guideway and near the rear end thereof with a trigger means pivotally supported by the rear grip and connected to an arm adapted to urge the hook shaped fitting of the glider out of a retaining portion of the launcher to permit the tensioned rubber band to forwardly propel the glider along and away from the launcher.

5 Claims, 3 Drawing Figures

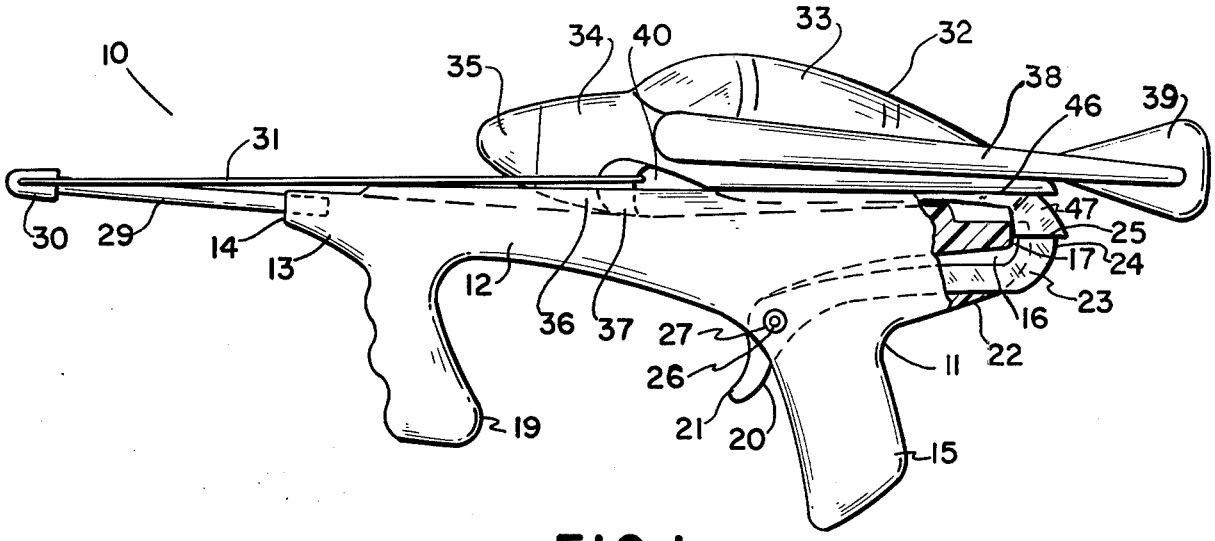
FIG. 1
FIG. 2
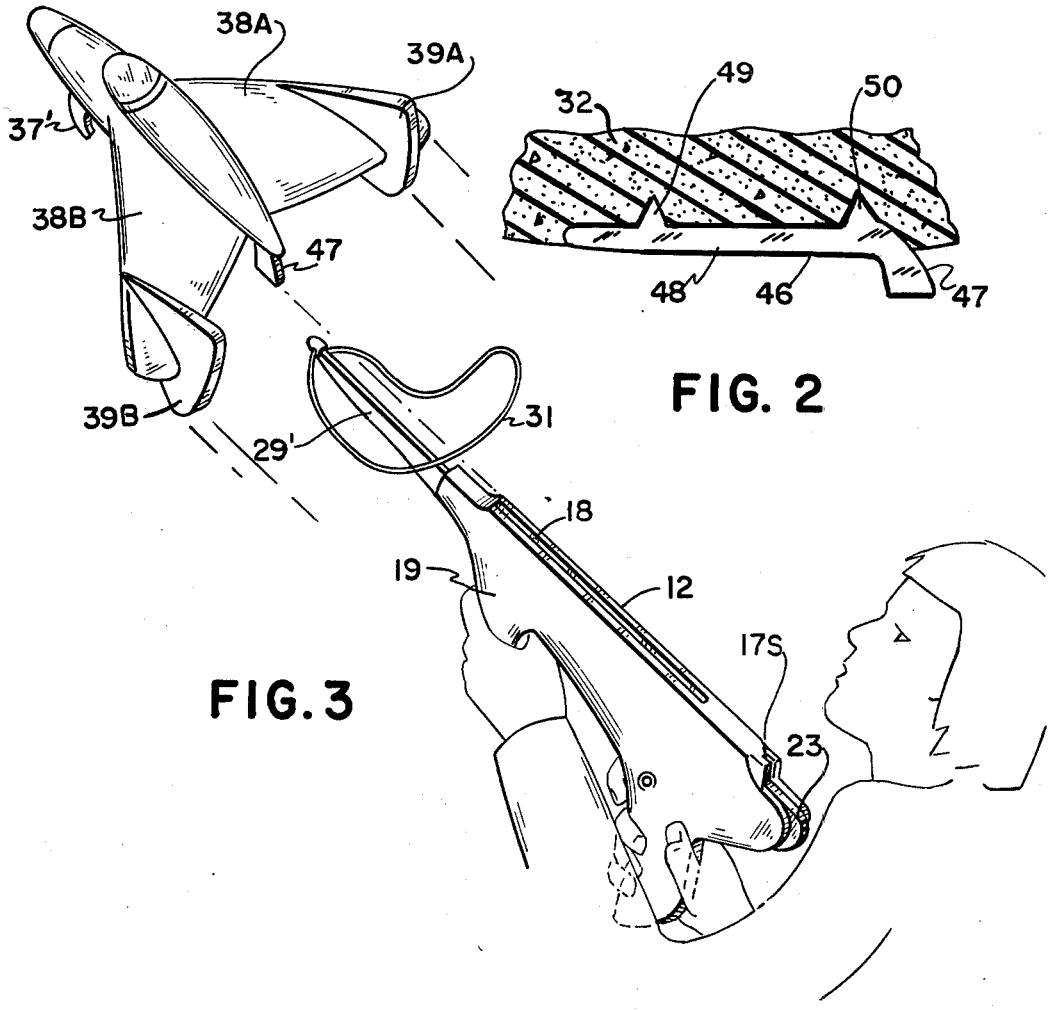
FIG. 3

CATAPULT LAUNCHED MODEL GLIDER

SUMMARY OF THE INVENTION

This invention relates to a flying toy in the configuration of a glider which is preferably molded of lightweight cellular plastic and of such a structure that it may be easily catapult launched. The invention is also concerned with a catapult launching device for such a glider which is extremely simple in structure and, capable of being produced at low cost and is practically foolproof in operation.

Accordingly, it is a primary object of this invention to provide a new and improved flying toy and a launcher therefore.

Another object is to provide a flying toy in the configuration of a model glider and a catapult launcher therefore, which glider is light in weight and configured so as to be safe to catapult launch.

Another object is to provide a lightweight, safe flying toy in the configuration of a glider which is made of extremely light cellular plastic material which, in itself, is incapable of withstanding the stress forces exerted by means of a catapult launching device wherein a more rigid plastic material forms a reinforcing and retaining means for the glider and is attached to the glider to permit the proper launching thereof by means of a catapult.

With the above and such other objects in view as may hereafter more fully appear from a study of the following specification and the annexed drawings, the invention consists of the novel constructions and combination of elements defining the flying toy but it is to be understood that changes and modifications may be resorted to coming within the purview of the claims without departing from the spirit and nature of the invention.

In the drawings:

FIG. 1 is a side view with parts broken away for clarity of a combined toy glider and launcher therefore;

FIG. 3 is an isometric view of the toy glider and launcher of FIG. 1 showing the glider as it is launched, and FIG. 2 is a partially sectioned fragmentary view of a portion of the body of the model airplane shown in FIG. 1.

In FIGS. 1 and 2 are shown details of a flying toy 10 comprising a model airplane glider 32, shown supported in FIG. 1 on a launching device 11 which is a portable hand-held unit comprising a body or stock 12 having two hand grips 15 and 19 depending downwardly therefrom.

While the glider 32 is preferably molded of a lightweight cellular plastic material such as rigid polystyrene foamed plastic resin, the launching unit 11 may be molded of two or more sections of rigid plastic material such as high impact polystyrene, cellulose acetate, rigid polyvinyl chloride or other suitable low cost resin.

The forward end 13 of the launcher stock 12 is shown containing an opening 14 therein in which opening an elongated rigid plastic rod or wooden dowel 29 is retained and protrudes a distance therefrom. The stock 12 may also be fabricated with an extension of the forward end 13 eliminating the need to provide a rigid rod or dowel at the end of the stock. A retaining device or fitting 30 is secured to the end of dowel 29 and retains a flexible rubber band which is stretched rearwardly, as illustrated in FIG. 1, when engaged by a retaining portion of the glider, a the glider is pulled backwardly along the upper portion of the stock 12, so as to provide propulsion means for the glider when the rubber band urges same forwardly upon release of the glider from its retained position.

The glider 32 is provided with a body portion 33 having a front end portion 34 to the end of which is secured a flexible nose 35 which may comprise a molding attached to the front end of 34 which serves as a nose weight and a protection means to prevent damage to the glider or objects which it may strike. The lower portion 36 of the front end 34 of the glider body 33 is molded with a recess 40 therein, either in the shape of a hook-like retainer for the end of the rubber band 31 or to receive a rigid plastic fitting 37 which is hook shaped to retain the rubber band 31 and permit the glider to be drawn rearwardly against the tension of the rubber band to the position illustrated in FIG. 1. A wing 38 comprising right and left hand wing portions 38A and 38B, is preferably molded integrally with the body 33 and is shown containing vertical fins 39A and 39B which serve as rudders and flight stabilizers for the glider. Secured within a channel formed in the underside of the rear portion of the body 33 is an elongated retainer 46 for the glider having a rear L-shaped portion 47 extending downwardly from the main body portion 48 and serving, as illustrated in FIG. 1, to retain the glider at the rear end of the launching device 11 when the inside edge of portion 47 thereof engages the rear face 17 of the front wall of an indentation 17S formed in the upper portion of the rear end of the stock 12.

The release mechanism 20 for the glider is pivotally supported on a pin 26 and includes an elongated arm 22 extending from the trigger 21 through a channel 16 formed between the side walls of the stock 12. The rear end portion 23 of arm 22 extends upwardly therefrom and its endmost portion 24 has its face 25 disposed beneath or engaging the bottom face of the end portion 47 of the L-shaped retainer 46 for the glider. A channel 18 is shown formed in the upper wall of the central portion of the stock 12 for receiving and guiding the lowermost portion of the hook shaped fitting 37.

When the forefinger of the hand holding the pistol grip 15 is brought to bear against the front face of the trigger 21, the arm 22 is rotated counterclockwise on the pivot 26 causing its end face 25 to push upwardly against the extension 47 of the fitting 46, thus lifting the front face of 47 away from the rear wall 17 and permitting the stretched rubber band 31 to rapidly draw and catapult the glider 32 forwardly off the launcher as illustrated in FIG. 3. Notation 27 relates to a coil spring which is connected to the trigger 21 and its pivot to normally urge the trigger in a clockwise direction although such action may be effected by gravity.

Details of the L-shaped fitting 46 are shown in FIG. 2. Upwardly extending spike-like portions 49 and 50 of the fitting may be pushed by hand into the deformable cellular plastic material of the glider body to retain the fitting in place in a channel molded therein and adhesive may also be employed to hold said fitting in place.

In launching the glider, the grip 19 is held in one hand, as illustrated in FIG. 3, while the rear pistol grip 15 is held in the other hand permitting a child to aim the launcher in a given direction and the forefinger of the hand holding the pistol grip 15 is employed to pull the trigger 21 to effect release of the glider from its held position so that it may be launched by means of the rubber band as illustrated.

By providing the glider 32 molded of a lightweight cellular plastic such as Styrofoam which is a molding material manufactured by the Dow Chemical Company of Midland, Michigan or Pelespan, a cellular plastic polystyrene molding material manufactured by the Koppers Company of Pittsburgh, Pa, a lightweight, large and safe flying toy is derived which may be easily launched from a launching device of the type illustrated in FIGS. 1 and 3 without the danger of injury to a nearby person. However, such lightweight and relatively weak foamed plastic materials are generally not strong enough to provide resistance against damage or breakage thereof at those portions where the rubber band attaches to the glider and the glider attaches to the launcher. As a result, the unique reinforcing means denoted 37 and 46 are preferably provided by adhesive bonding or integrally molding said reinforcements to the body of the glider at the locations illustrated.

In a preferred form of the invention, the launching device 11 is between 16 and 24 inches long and the glider 32 is formed by expanding Pelespan expanded polystyrene pellets in a single cavity of a mold with the body 33 being approximately nine inches in length, the span of the wing 38 being approximately ten inches from tip to tip and the total weight of the glider being between one and one and a half ounces. Such a glider, when catapult launched by the described launching device using a ⅛ inch by 8 inch long loop of rubber band 31 will not only make long, smooth gliding flights when launched with the launcher in a horizontal attitude or aimed slightly downwardly but may also be employed to ascribe climbing turns and loops without difficulty by properly aiming the launcher with the hands. Accordingly young children and inexperienced older children may easily fly a glider of the type described, a task which would be quite difficult if the glider were hand launched in the manner in which conventional glider toys are flown.

I Claim:

1. A flying toy comprising in combination:

a model aircraft in the configuration of a glider formed of cellular plastic material of relatively low density, a retaining device comprising an elongated spine-like member which extends along and is at least partially embedded within the cellular plastic of said glider and is shaped with a protrusion, said retaining device being formed of a material having a substantially greater density and strength than the cellular plastic material forming said glider, said retaining device being secured to said glider along the bottom portion thereof, a launching device containing an elongated support for said glider and retaining means for engaging and retaining said protrusion of said retaining device attached to said glider, a loop of rubber band material secured to said launching device, retaining means forming part of said glider and adapted to be retained within said loop of rubber band material in a manner whereby, when said retaining device of said glider and said retaining means of said launching device are operatively engaged, said rubber band material will be pulled in tension backwardly along said launching device and will exert a force on said glider, and release means in the form of a movable member movably supported by said launching device and manually movable from a first position to a second position whereby, when moved to said second position, said release means will urge said retaining device of said glider away from said retaining means of said launching device and will permit the tensioned rubber band to catapult said glider forwardly along said elongated support and to propel said glider forwardly and upwardly of said launching device.

2. A flying toy in accordance with claim 1 wherein said launching device contains a pistol grip extending downwardly therefrom and said release means includes a trigger means pivotally supported at said pistol grip and means connected to said trigger means which is adapted to be projected against said retaining device for said glider to urge said glider upwardly and away from said retaining means of said launching device.

3. A flying toy in accordance with claim 2 including a second grip located forward of said piston grip to permit said launcher to be held by both hands of a person operating said toy.

4. A flying toy in accordance with claim 1 wherein said glider is formed of a unitary molding comprising a wing portion and a body portion formed at the center of said wing portion, said retaining means being retained within and protruding downwardly from the rear portion of said body portion.

5. A gliding toy for use with a catapult launching device which launching device includes spring means rubber band for catapulting said toy into gliding flight, said gliding toy being formed with a body portion made at least in part of low density cellular plastic having relatively low strength, an elongated spine-like member formed of a material having substantially greater rigidity and strength than said cellular plastic material forming said body portion of said flying toy, said elongated member being partly embedded within and secured to said body portion of said glider which is made of said low density cellular plastic, said elongated member having a downwardly extending protrusion near the rear end thereof to serve as a retaining means for the spring means of said catapult launching device when said launching device is operatively engaging said gliding toy during the act of catapult launching same.

* * * * *